US005755433A

United States Patent [19]

Klein

[11] Patent Number: 5,755,433

[45] Date of Patent: May 26, 1998

[54] METHOD AND APPARATUS FOR HIGH SPEED ENVELOPE PRINTING

[76] Inventor: Glenn F. Klein, 22561 Sunbrook, Mission Viejo, Calif. 92692

[21] Appl. No.: 738,268

[22] Filed: Oct. 25, 1996

Related U.S. Application Data

[63] Continuation-in-part of Ser. No. 427,580, Apr. 24, 1995, abandoned.

[51] Int. Cl.[6] ..... B65H 5/00

[52] U.S. Cl. ..... 271/2; 271/107; 271/122; 229/80; 229/80.5; 493/210; 221/231

[58] Field of Search ..... 271/2, 167, 122; 229/80, 80.5, 82, 84; 493/210, 220; 221/208, 231, 232, 255

[56] References Cited

U.S. PATENT DOCUMENTS

| | | | |
|---|---|---|---|
| 684,181 | 10/1901 | Briery | 493/210 |
| 3,370,845 | 2/1968 | Newcomb | 271/107 |
| 3,936,044 | 2/1976 | Kramer | 271/122 |
| 3,999,701 | 12/1976 | Ward | 229/87 R |
| 4,192,498 | 3/1980 | Toto | 271/21 |
| 4,522,385 | 6/1985 | Stefansson | 271/122 |
| 4,807,805 | 2/1989 | Rutkowski | 229/80 |
| 4,821,916 | 4/1989 | Dewaele | 221/231 |
| 4,915,288 | 4/1990 | Kao et al. | 229/80 |
| 4,915,369 | 4/1990 | Rutishauser | 271/2 |
| 4,993,587 | 2/1991 | Abe | 271/122 |
| 5,238,143 | 8/1993 | Crighton | 221/255 |
| 5,377,969 | 1/1995 | Steinhilber | 271/117 |

*Primary Examiner*—H. Grant Skaggs
*Attorney, Agent, or Firm*—Bernard L. Kleinke

[57] ABSTRACT

An envelope construction for high speed printing includes a front panel having a flap with a sealing adhesive strip on its back side, and a rear panel secured to the front panel at its marginal edges to form a pocket. The thickness of the adhesive strip is substantially the same as the thickness of the rear panel so that when the flap is opened, the overall configuration of the envelope is flat to facilitate stacking and feeding. The combination of the strip and the rear panel are both secured to the back side of the front panel, and the combination adds a layer of a uniform thickness to provide the desired flat aspect. Like such envelope constructions are arranged in a stack within a paper tray. The topmost one of the envelope constructions is separated from the stack seriatim at high speeds to feed them individually to the printer for printing thereon.

29 Claims, 12 Drawing Sheets

METHOD AND APPARATUS FOR HIGH SPEED ENVELOPE PRINTING

CROSS-REFERENCE TO RELATED APPLICATIONS

This application is a continuation-in-part application of patent application Ser. No. 08/427,580, filed Apr. 24, 1995, and entitled "ENVELOPE CONSTRUCTION AND METHOD OF MAKING AND DISPENSING SAME," and now abandoned which is incorporated herein by reference.

TECHNICAL FIELD

The present invention relates in general to a method and apparatus for high speed printing. More particularly, the present invention relates to an envelope construction which can be fed seriatim to non-impact printers, and which can be dispensed from a kiosk or the like.

BACKGROUND ART

For many business documents, standard size business envelopes are used. However, because of the difficulty associated with having such envelopes printed by a non-impact desk top printer, such as laser and ink jet printers, many people are still typing or manually addressing envelopes, even in a business environment. This process is time consuming, and is not consistent with the speed of processing documents in a modern office setting.

Even when feeding a single conventional multifold envelope into a non-impact printer, several difficulties in printing the envelope arise. Usually, the envelope is severely crumpled or puckered, and the envelope may even jam the printer. Moreover, the heat associated with laser printers and the moisture associated with ink jet printers cause undesirable effects on the envelope during the printing process. For example, the gummed envelope can become inadvertently sealed, rendering the printed envelope unusable. Therefore, it would be highly desirable to have a new and improved envelope construction, which could facilitate printing of envelopes using non-impact printers without the difficulties often times encountered in printing conventional envelopes.

There have been various envelope constructions invented to overcome this problem of wrinkling, puckering and crumpling when passing through a printer. In this regard, reference may be made to U.S. Pat. Nos. 5,377,904, 5,201,464, 4,898,323, 4,878,613, 3,968,927, 4,277,016, 3,823,867 and 4,784,317.

For example, in U.S. Pat. No. 4,878,613, a partially constructed envelope is adapted to be fed into a laser printer, which causes the completion of the forming of the envelope as a result of the heat produced by the laser printers. A line of heat activatable adhesive is employed to facilitate this process.

After the envelope is formed, a portion of the assembly must be removed, thereby leaving an undesirable uneven, ragged edge. This also takes additional time and creates wasted material. Therefore, it would be highly desirable to have a new and improved envelope construction, which would pass through non-impact printers without being wrinkled, crumpled, puckered, or otherwise damaged.

Even greater difficulties arise when attempting to print numerous stacked-like envelopes using non-impact printers. Due to the thickness of standard envelopes, it is difficult, if not impossible, to feed large quantities seriatim into a printer. When the gummed flap is folded over in order to present a rectangular envelope to a printer, the closed envelope does not have a constant thickness. Thus, a large stack of such envelopes poses the problem of having an uneven and non-uniform configuration. With an uneven stack, it is difficult, if not impossible, to feed properly and consistently a large number of envelopes seriatim through a conventional sheet feeder mechanism. Therefore, it would be highly desirable to have a new and improved envelope construction, which facilitates the reliable and consistent feeding of large quantities of envelopes without jamming or damaging the envelopes.

Another problem with many conventional envelopes, is that a crease is formed where the gummed flap is joined to the body of the envelope. This facilitates closing the envelope. In some envelopes, the crease is formed by scoring the paper. As a result, there is an impression or indentation made in the paper, and when the envelopes are stacked, they tend to nest at the score lines. When nested envelopes are attempted to be fed into a conventional sheet feeder, they do not singularize readily and more than one can be presented inadvertently to the feeder mechanism in an undesirable manner. As a result, jamming of the feeder mechanism can occur. Therefore, it would be highly desirable to have an envelope construction, where large quantities of the envelopes can be stacked and fed seriatim through a conventional sheet feeder in a reliable and consistent manner.

The printing of customized documents such as greeting cards, at kiosks has become popular. Members of the public who have access to such kiosks can create personalized documents using computers and printers associated with the kiosks. Therefore, it would be highly desirable to have a new apparatus which dispenses blank or customized envelopes from a kiosk-type structure.

At the present time, dispensing envelopes from a kiosk is extremely difficult, if not impossible, mainly due to the fact that standard envelopes cannot be stacked properly for proper presentation to a conventional sheet feeder, due to the difficult problem of stacking conventional envelopes. Any kiosk dedicated to dispensing envelopes to the public would have to store and feed a very large number of envelopes to keep maintenance and restocking of the kiosk within reasonable and profitable limits. In this regard, 500 or even 1,000 envelopes would be desirable. Therefore, it would be highly desirable to have a new and improved apparatus for dispensing envelopes at a public facility, free-standing kiosk. Such an apparatus should be capable of storing and delivering in a highly reliable manner, a large number of envelopes.

The problem of storing a large quantity of stacked envelopes is compounded in a high humidity environment. Kiosks, while normally sheltered from the elements, may be located in public areas, such as open malls and other such locations, where the atmosphere is not necessarily controlled. Thus, such kiosks may frequently encounter high humidity environments.

Humidity can contribute to improper feeding of paper products, such as paper sheets and paper envelopes. All paper stock has a natural curl due to modern paper manufacturing methods. This natural curl can become greatly accentuated, when the paper absorbs moisture from the atmosphere thereby causing the paper to curl. Paper envelopes, when stacked to be fed through a conventional sheet feeder mechanism, tends to warp and to curl in higher humidity environments thus, making the envelopes positioned askew in a stack, which thus becomes canted and unstable. As a result, the envelopes are not properly presented to the sheet feeder and can result in improperly feeding the envelopes, and jamming can occur. Therefore, it would be highly desirable to have an envelope construction, which remains properly stacked, even under high humidity conditions, for sheet feeding purposes.

DISCLOSURE OF INVENTION

It is an object of the present invention to provide a new and improved method and apparatus for high speed printing in a reliable manner.

It is a further object of the present invention to provide such a new and improved method and apparatus, whereby envelopes can pass readily to and through non-impact printers at high speeds without undue wrinkling or jamming.

Briefly, according to the present invention, there is provided a new and improved high speed envelope printing method and apparatus which include an envelope construction having a front panel with a flap sealing adhesive strip on its back side, and a rear panel secured to the front panel at its marginal edges to form a pocket. The thickness of the adhesive strip is substantially the same as the thickness of the rear panel so that when the flap is opened, the overall configuration of the envelope is flat to facilitate stacking and feeding like envelope construction to and through a non-impact printer at high speeds.

The combination of the strip and the rear panel are both secured to the back side of the front panel, and the combination adds a layer of a uniform thickness to provide the desired flat aspect for stacking purposes. A line of perforations in the front panel between the adhesive strip and the rear panel with the flap portion opened do not deform the front panel and thus interfere with the high speed operation. The front and rear panels have opposing curls facing each other to retain the flat aspect of the envelope, even when the envelope absorbs moisture, thereby facilitating the high speed operation.

A group of like such envelope constructions are arranged in a stack within a paper tray. The topmost one of the stack of like envelope constructions is separated from the stack seriatim at high speeds to feed them individually to the printer for printing thereon.

An advantage of the present invention is seen in the fact that the novel construction of the envelope prevents warping or curling in high humidity environments and this attribute allows the envelope to be stored in large quantities in a stacked arrangement. Thus, if desired, the envelopes can be dispensed to the public from an apparatus, such as a kiosk having an envelope dispensing apparatus integrated therein at high speeds.

A further advantage of the present invention is that since the envelope construction may be formed of two separate panels, the two panels can be two different sheets of paper, each having a different weight. In this regard, a heavy bond paper can be used for the front panel and a lighter weight bond can be used for the rear panel when the envelopes are to be used in formal correspondence applications. In this manner, a high quality envelope results, and yet its overall weight is lower, thereby reducing the cost of postage required.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
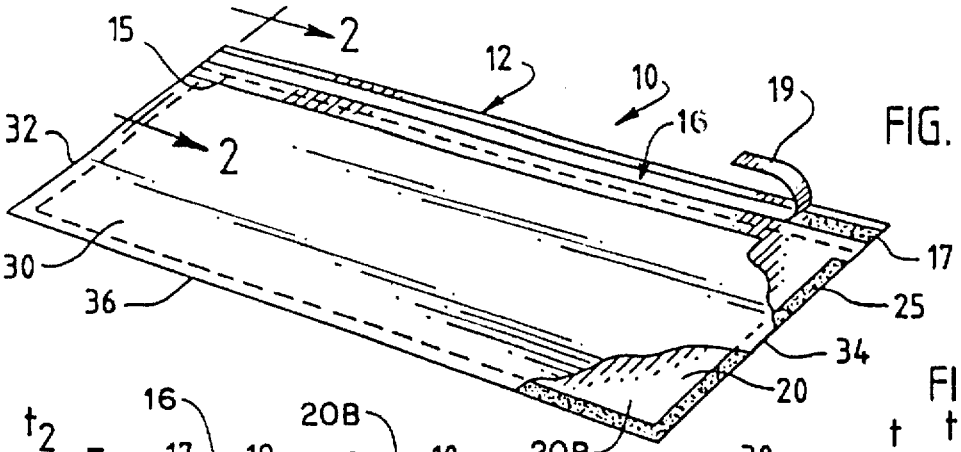
FIG. 1 is a partially cut away pictorial view of an envelope construction which is constructed in accordance with the present invention.
Figure 2:
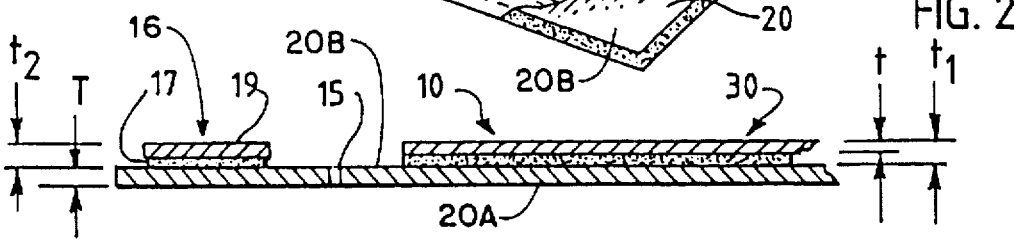
FIG. 2 is a fragmentary, enlarged sectional view of the envelope construction of FIG. 1, taken substantially on line 2—2 thereof.
Figure 3:
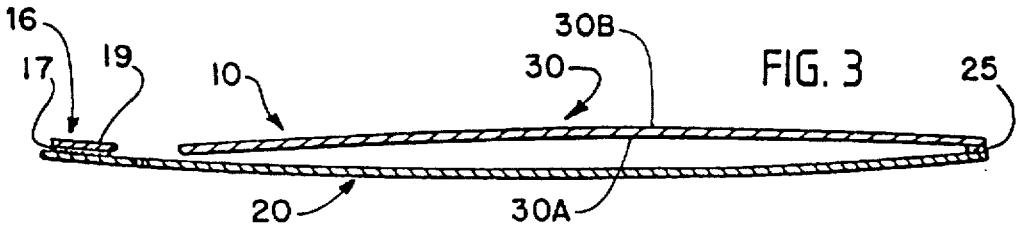
FIG. 3 is an enlarged longitudinal sectional view of the envelope construction of FIG. 1, illustrating the opposing curl configurations of the front and rear panels.

Referring now to the drawings, and more particularly to FIGS. 1, 2 and 3 thereof, there is shown a new envelope construction 10, which is constructed in accordance with the present invention. The envelope construction 10 can be readily and conveniently fed through a non-impact printer, without having a tendency to be peeled shut from the heat produced by a laser printer (not shown) or the humidity produced by an ink jet printer. Also, the envelope construction 10 will not damage the printer fuser (now shown) of a laser printer, since the construction 10 is protected from adhesive from being inadvertently transferred therefrom to the printer.

Due to the novel construction of the envelope 10, envelopes made in a manner of the envelope construction 10, can be stacked flat in a symmetrical manner without leaning or tilting, and thus can be fed at high speeds for envelope printing purposes as hereinafter described in greater detail. The envelopes can be stocked in their opened conditions, as indicated in FIG. 1, and can be fed reliably through a conventional sheet feeder (not shown) without adhesive contamination or premature self-sealing. approximately 200 envelopes made like the construction 10 can be stacked in a conventional 500 sheet paper tray (not shown) for feeding through a conventional non-impact printer at high speeds.

The envelope construction 10, generally comprises a large front panel on 20, and having a front side 20A, and a backside 20B, so that a small rear panel 30 is disposed in an overlying relationship on the backside 20B of the front 20 and is secured in place thereof. At three marginal edges 32, 34, and 36 to form an interior pocket P (FIG. 1). The rear panel has a front side 30A and a backside 30B. A flap portion generally indicated at 12 of the front panel 20 extends beyond the rear panel to form a fold over flap for the envelope construction 10 so that the contents (not shown) and the pocket P can be retained in place in a convenient manner. In order to secure the flap in its closed position, an adhesive strip generally indicated at 16 extends across the backside 20B of the front panel 20 at the flap portion 16 near one of the its marginal edges so that the flap portion can be sealed in a closed folded over position.

The rear panel 30 and the adhesive strip 16 are generally of the same thickness to add a substantially uniform thick layer to the backside 20B of the front panel 20 to provide the envelope construction with a generally flat aspect to enable a group of like envelope constructions to be stacked evenly for sheet feeding purposes.

As best seen in FIG. 3, the front panel 20 and the rear panel 30 each assume its natural curl and in a confronting relationship with one another to form a symmetrical shape to help retain the overall symmetrical shape of the construction constant, even when the panels absorb moisture to facilitate greatly sheet feeding purposes.

In order to maintain a flat aspect to the envelope construction 10, a perforation line 15 in the front wall 20 extends between the adhesive strip 16 and the rear panel 30 entirely across the longitudinal length of the large front panel 20. The perforation line 15 facilitates the folding over of the flap portion 12. Once the flap portion 12 is sealed in place, the envelope construction 10 can be more readily opened, such as with a letter opener (not shown) or similar tool. Also, in accordance with the present invention, the perforation line 15 does not deform the front panel 20, and thus the envelope construction 10 assumes a flat configuration as best seen in FIG. 2. The adhesive strips 16 includes an adhesive line 17 covered over by a peal off backing strip 19. In this manner, the envelope construction 10 can be fed through a sheet feeder (not shown) and into a non-impact printer (not shown) without prematurely sealing the envelope construction, since the adhesive 17 is of a pressure sensitive type, and is covered over by the peal-off backing strip 19. Strip 19 can be removed as shown in FIG. 1 prior to sealing the envelope construction 10.

In order to assemble the envelope construction 10, the front and rear panels are positioned in overlying relationship as indicated in FIG. 1. In this regard, three of the marginal edges are aligned as indicated at 32, 34 and 36. A U-shaped strip of adhesive 25 extending along the three marginal edges, 32, 34 and 36 to fixed together the two panels to form the pocket P.

The adhesive strip 16 is then secured to the backside 20B of the front panel 20 and secured in place by the adhesive 17. The perforation line 15 is formed by conventional means (not shown) in the front panel 20 either prior to the assembly with the rear wall, or afterwards.

Considering now the envelope construction 10 in greater detail with reference to FIG. 2, the front panel 20 has a thickness T, and a rear panel 30 has a thickness the rear panel 30 and the adhesive layer 25 have thickness $t_1$.

The adhesive strip line 17 and peel-off backing strip 19 have a combined or overall thickness $t_2$. A uniform overall thickness in the envelope construction is achieved by configuring the envelope components such that $t_1$ substantially equals $t_2$. In this regard, the rear panel 30 and the adhesive line 25 have a combined thickness $t_1$ substantially equal to the combined thickness $t_2$ of the adhesive strip 17 and the peel-off backing strip 19. This enables large numbers of the uniformly thick symmetrical envelopes made according to the construction 10, to be stacked evenly without the stack being slanted or leaning to one side. The result is that the novel envelope construction facilitates reliable feeding and continuous printing of large numbers of envelopes using non-impact printers, without the difficulties encountered in printing conventional multifold envelopes.

As indicated in FIG. 3, the panels 20 and 30 are composed of paper material, and have a material curl, which causes the paper sheet to be bowed from end to end, as shown in FIG. 3, the curl becomes exaggerated in high humidity environments as a result of the absorption of moisture.

According to the present invention, the curl of the paper material forming the front panel 20 and the paper material forming the rear panel 30 are arranged in a confronting relationship with one another to form a symmetrical slightly elliptical shape. thus, when moisture is absorbed, the panels 20 and 30 tend to bow further away from one another, but they retain an overall symmetrical configuration.

Each one of the panels 20 and 30 is composed of paper material having a suitable thickness and stiffness to enable the envelope construction 10 to be properly fed through a sheet feeder. If there is too little calendaring, the panel is too limp and does not have sufficient body for the feeding. On the other hand, if there is too great a calendaring, the resulting envelope is too stiff, and it does not bend readily as it is fed through a non-impact printer.

In accordance with the present invention, the panels 20 and 30 are each composed of paper material having a caliper of between about 3.00 mils and about 5.50 mils. The most preferred caliper is of 4.00 mils and a porosity of about 11.0 Gurley units.

Additionally, the paper material forming the front and rear panels should have sufficient surface smoothness to be properly fed by a sheet feeder and then through a non-impact printer. If the paper material is too slick, it will not be fed properly. If the roughness is too great, there is too much rag content in the paper material and lint can form on the rollers (not shown) of the equipment.

The paper material forming the front and rear panels 20 and 30 has a surface smoothness of between about 85

Sheffield and about 150 Sheffield. The most preferred surface smoothness is about 100 Sheffield.

Figure 4:
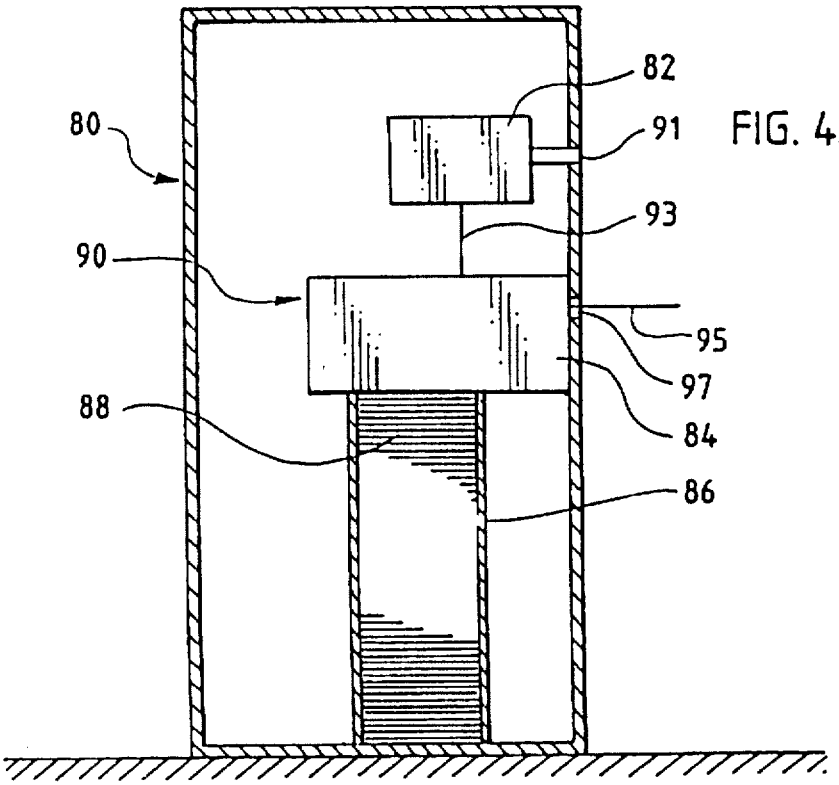
FIG. 4 is a diagrammatic view of an envelope dispensing apparatus constructed in accordance with the present invention.

Referring now to the drawings, and more particularly to FIG. 4 thereof, there is shown an envelope dispensing apparatus 90, which is constructed in accordance with the present invention. The envelope dispensing apparatus 90 is disposed within a protective housing 80 to serve as a vending machine for the public.

The apparatus 90 is adopted to dispose envelopes in their open positions, and one is made according to the envelope construction 10 of FIG. 1. In operation, a customer can make a payment for one or more of the envelopes, and the envelopes are then dispensed to the customer.

The envelope dispensing apparatus 90 includes a payment mechanism 82, which will accept payment for envelopes, in the form of coin, currency, or magnetic strip credit/debit cards. The apparatus 90 also includes a sheet feeder 84 connected to an envelope storage bin 86 containing a stack of like envelopes 88, each of which is similar in construction to the envelopes construction 10 of FIG. 1. The stack of envelopes 88 can include a large number of envelopes, such as 500 to 1000 envelopes. Due to the unique flat, symmetrical construction of the envelope, the stack is even, and the envelopes are fed reliably through the feeder 84.

In operation, a customer would enter payment via a payment chute 91. Once a proper payment has been accepted, the payment mechanism 82 activates the sheet feeder 84 via a electrical cable 93, which conveys a signal from the payment mechanism 82 to the sheet feeder 84 to commence the feeding of envelope.

Upon activation, the sheet feeder 84 picks up envelopes 88 seriatim stored in the bin 86, and moves them through the envelope outlet slot 97, exposing the envelope 95 to the customer (not shown). The customer can then conveniently remove the disposed envelopes, such as the envelope 95. The vending process can then be repeated.

Because of the flatness, uniform thickness, and resistance to curling or warping, the envelope construction of the present invention makes it possible to vend envelopes in this manner, even through the apparatus 90 is located where the environment is not regulated. High humidity has little or no affect on the reliability of the vending of the unique envelopes. Preprinted, custom printed, or blank envelopes can be vended in this manner, depending upon the desired design and related system employed.

Figure 5:
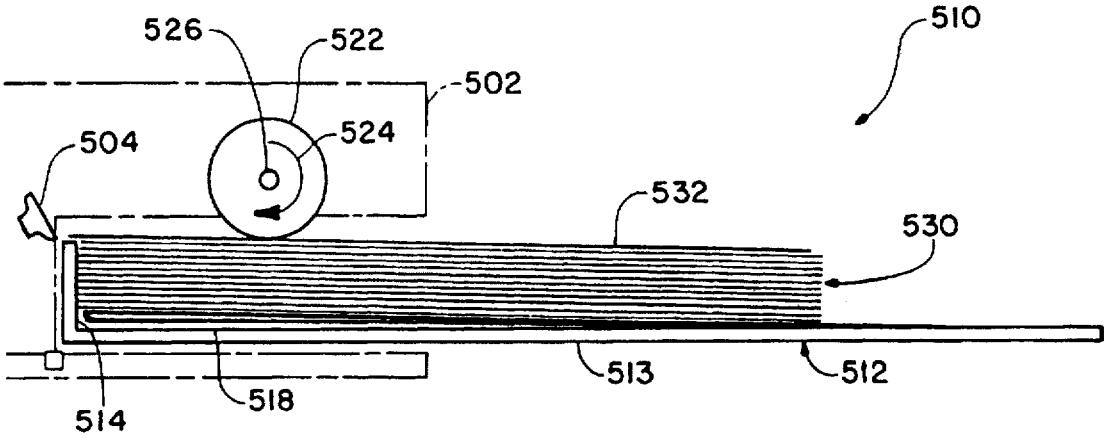
FIG. 5 is a sectional view of a sheet feeder apparatus for feeding the envelope construction of FIG. 1, and which is constructed in accordance with the present invention.
Figure 6:
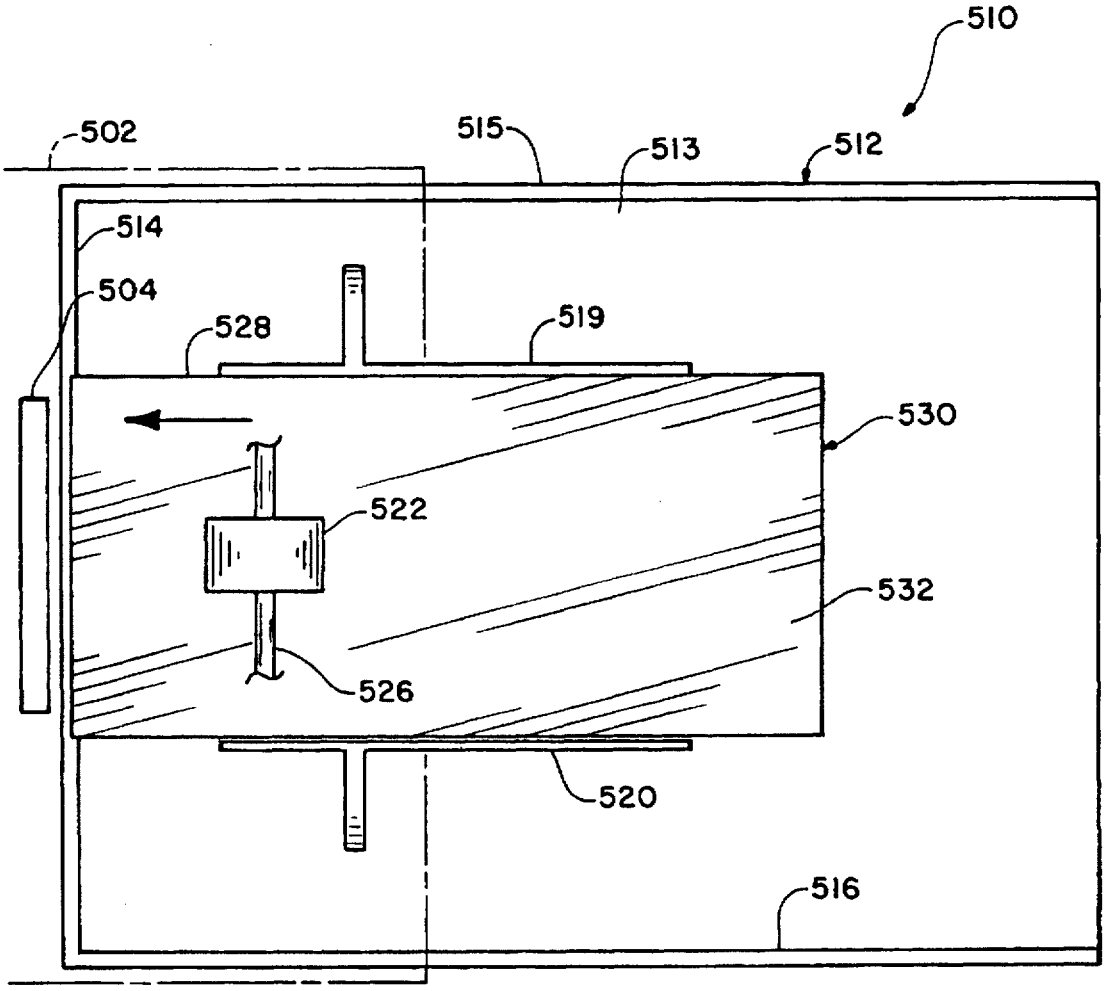
FIG. 6 is a plan view of the sheet feeder apparatus of FIG. 5.
Figure 7:
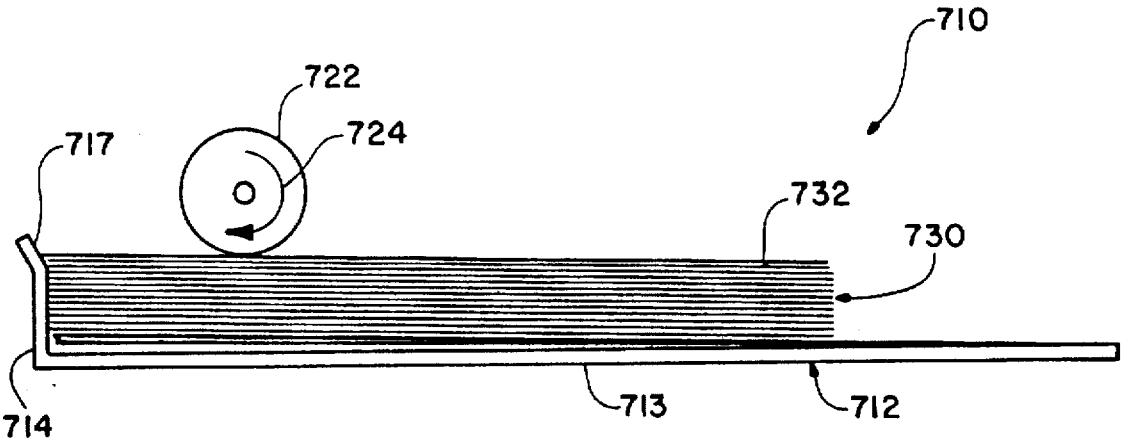
FIG. 7 is a sectional view of another sheet feeder apparatus for feeding the envelope construction of FIG. 1, and which is also constructed in accordance with the present invention.

Referring now to the drawings, and more particularly to FIGS. 5 and 6 thereof, there is shown a sheet feeder apparatus 510, which is constructed in accordance with the present invention. The sheet feeder apparatus 510 is received within a non-impact printer 502 to supply envelopes, such as the envelope construction 10, thereto. In this regard, the combination of the novel envelope construction 10 and the sheet feeder apparatus 510 used in accordance with the method of the present invention, enables a group of like envelope constructions to be printed at high speeds with little or no jamming in a highly efficient and effective manner.

The sheet feeder apparatus 510 is a passive retard type of sheet feeder, and is capable of supplying envelopes to the printer 502 at the rate of up to about 15 envelopes per minute ("epm"). The sheet feeder apparatus 510 includes a paper tray 512 having a bottom member 513, a pair of vertical side walls 515 and 516 disposed on opposite sides of the bottom 513, and a vertical front wall 514 connected to the bottom 513 and disposed between the side walls 515 and 516. The bottom 513, the side walls 515 and 516, and the front wall 514 are sized and dimensioned to be received in the printer 502, and to receive and store a plurality of envelopes, such as a stack 530 of envelopes for supplying the envelopes to the printer 502 at a relatively high rate. Each one of the envelopes is constructed in a manner similar to the envelope construction 10 of FIG. 1.

A pair of guide members 519 and 520 are disposed between the sidewalls 515 and 516, and spaced apart from one another a sufficient distance to receive the stack 530 therebetween. The guide members 519 and 520 engage opposite sides of the stack 530 to ensure that the envelopes are supplied to printer 502 at an appropriate location.

As shown in FIG. 6, the guide members 519 and 520 define a center justified feeding position. It will be understood by one skilled in the art that the guide members 519 and 520 may be adapted to define a right justified feeding position or a left justified feeding position. Furthermore, the spacing between the guide members 519 and 520 may be adapted to receive various sizes of envelopes as required.

A drive wheel 522 connected to an axle 526 engages the stack 530 to facilitate the transportation of the envelopes of the stack 530 to the printer 502. The printer 502 includes a retard pad 504 disposed at about the upper end of the front wall 514 for cooperating with the drive wheel 522 to help separate the top most envelope 532 of the stack 530 from the rest of the stack 530. A lift plate 518 disposed between the bottom 513 and the stack 530 urges the stack 530 upwardly to enable the top envelope 532 to be engaged by the drive wheel 522.

Each of the envelopes of the stack 530 includes a front side and a back side, wherein the front side receives printer indicia thereon. The envelopes may be stored in the tray 512 such that the front sides engage the drive wheel 522. Alternatively, the envelopes may be stored within the tray 512 so that the back sides engage the drive wheel 522. In this regard, the envelopes may be stored to accommodate the physical requirements of the printer 502.

In use, the stack 530 is placed in the tray 512 between the guides 519 and 520. The forward portion of the stack 530 is urged forwardly to engage the vertical front wall 514 to ensure that the stack 530 remains in place while the top envelope 532 is removed from the stack 530.

The tray 512 is received within the printer 502, wherein the front wall 514 is positioned adjacent and below the retard pad 504, and wherein the drive wheel 522 engages the top envelope 532. The axle 526 rotates the drive wheel 522 in a clockwise direction as indicated by the arrow 524. The rotating drive wheel 522 engages the top envelope 532 to move the top envelope 532 forwardly as shown by the arrow 528. The forwardly moving top envelope 532 engages the angled retard pad 504 to facilitate the singulation or separation of the top envelope 532 from the stack 530. Once separated from the stack 530, the top envelope 532 is directed along a paper path (not shown) within the printer 502 by conventional paper feeding mechanisms.

Another sheet feeder apparatus 710 is shown in FIGS. 7–10 for supplying envelopes to a printer (not shown) and is also constructed in accordance with the present invention. The sheet feeder apparatus 710 is also a passive retard sheet feeder and is substantially similar to the sheet feeder apparatus 510 (FIGS. 5 and 6). In this regard, the apparatus 710 includes a tray 712 having a bottom 713, side walls 715 and 716, and a front wall 714 for storing a stack 730 of envelopes therein. Unlike the sheet feeder apparatus 510, however, the sheet feeder apparatus 710 includes an angled retard pad 717 integrally connected to the upper portion of the front wall 714. The angled retard pad 717 cooperates with the drive wheel 722 rotating in a clockwise direction as indicated by the wheel 724 for separating a top envelope 732 from the stack 730.

Figure 8:
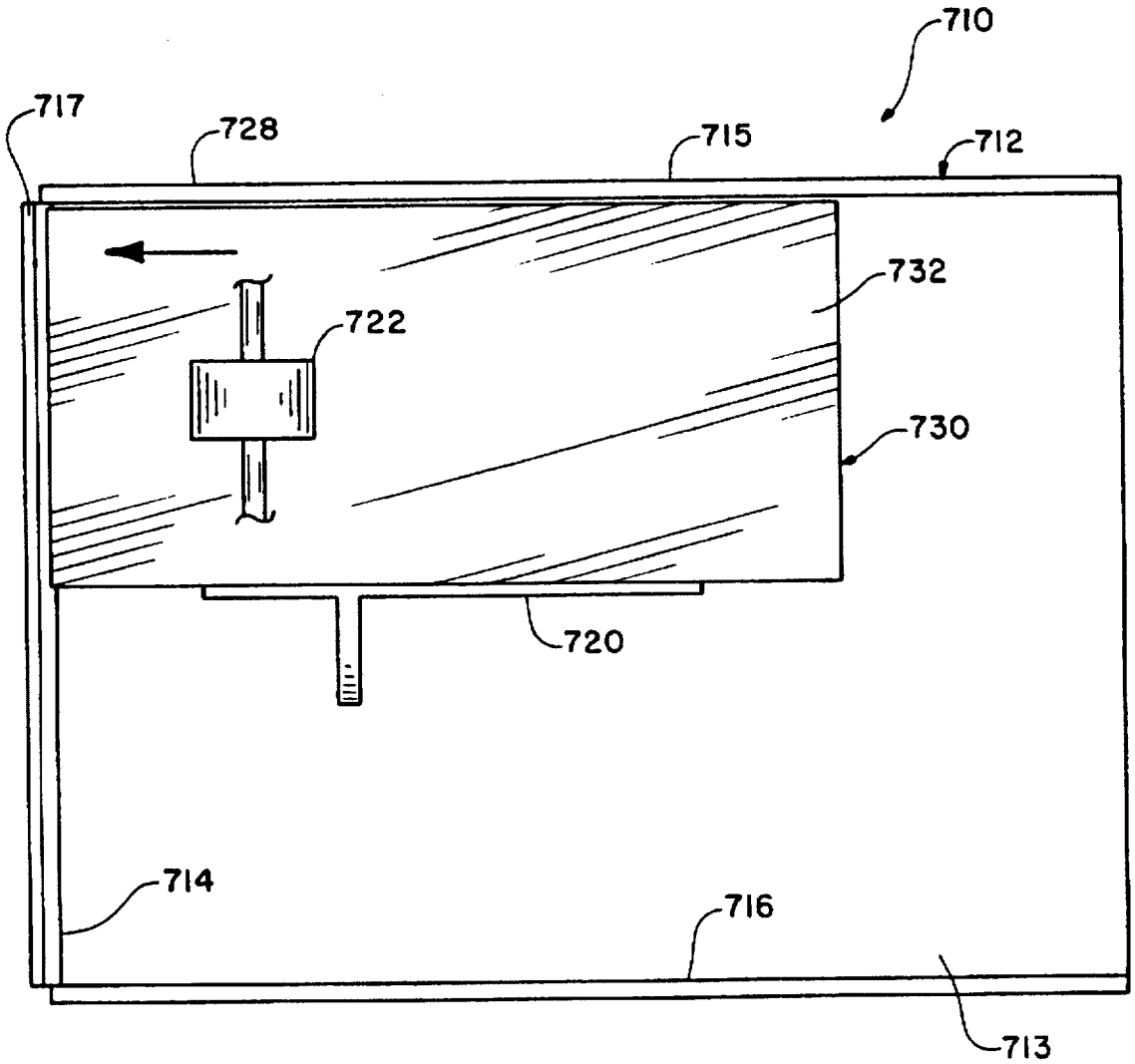
FIG. 8 is a plan view of the sheet feeder apparatus of FIG. 7 illustrating a right justified feeding position.

As shown in FIG. 8, the apparatus 710 is adapted for a right justified feeding position. A guide member 720 cooperates with the side wall 715 to receive the stack 730 therebetween. The rotating drive wheel 722 urges the top envelope 732 forwardly as indicated by an arrow 728 to enable the top envelope 732 to engage the angled retard pad 717, wherein the top envelope 732 is separated from the stack 732.

Figure 9:
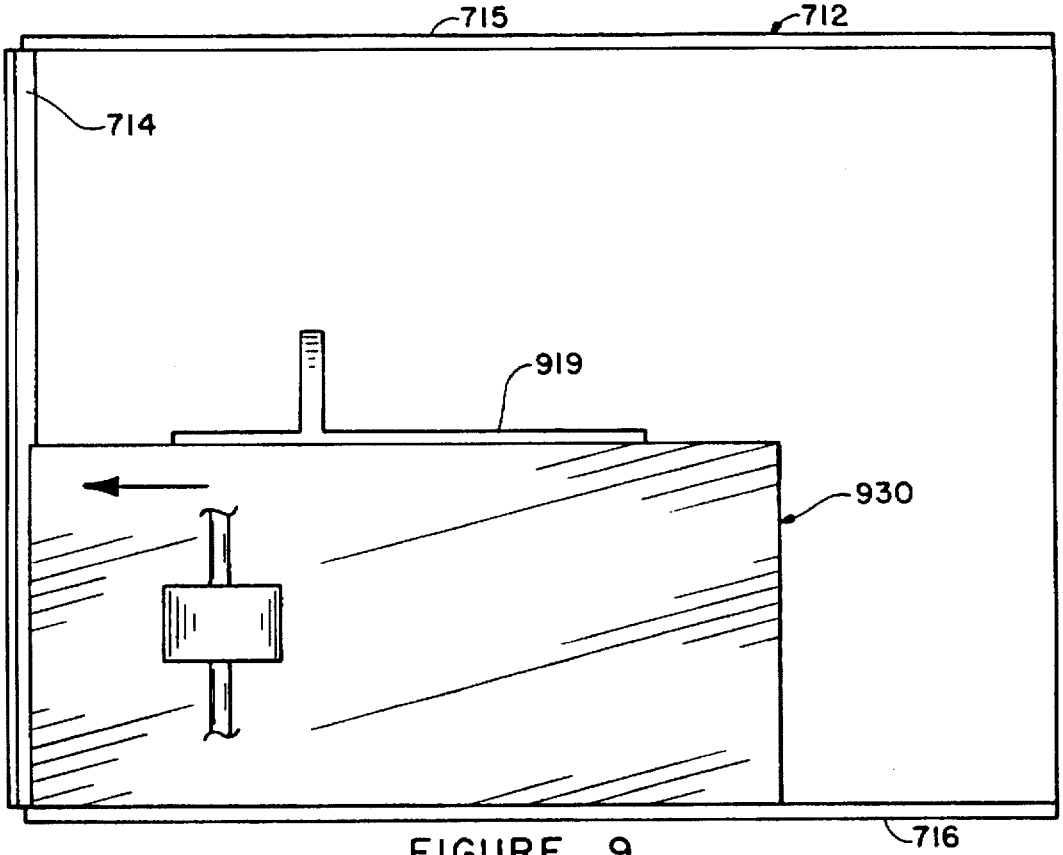
FIG. 9 is a plan view of the sheet feeder apparatus of FIG. 7 illustrating a left justified feeding position.

A left justified feeding position for the apparatus 710 is illustrated in FIG. 9. In this regard, a guide member 919 cooperates with the wall 716 to receive a stack 930 of envelopes therebetween.

Figure 10:
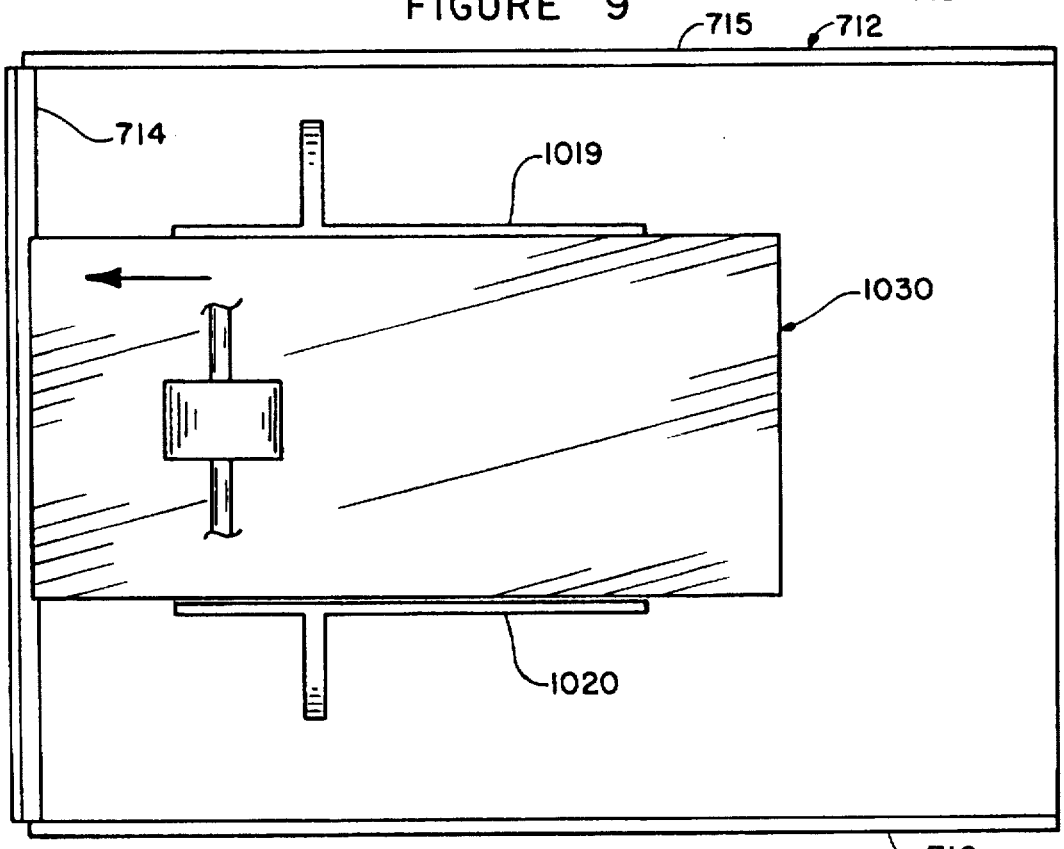
FIG. 10 is a plan view of the sheet feeder apparatus of FIG. 7 illustrating a center justified feeding position.
Figure 11:
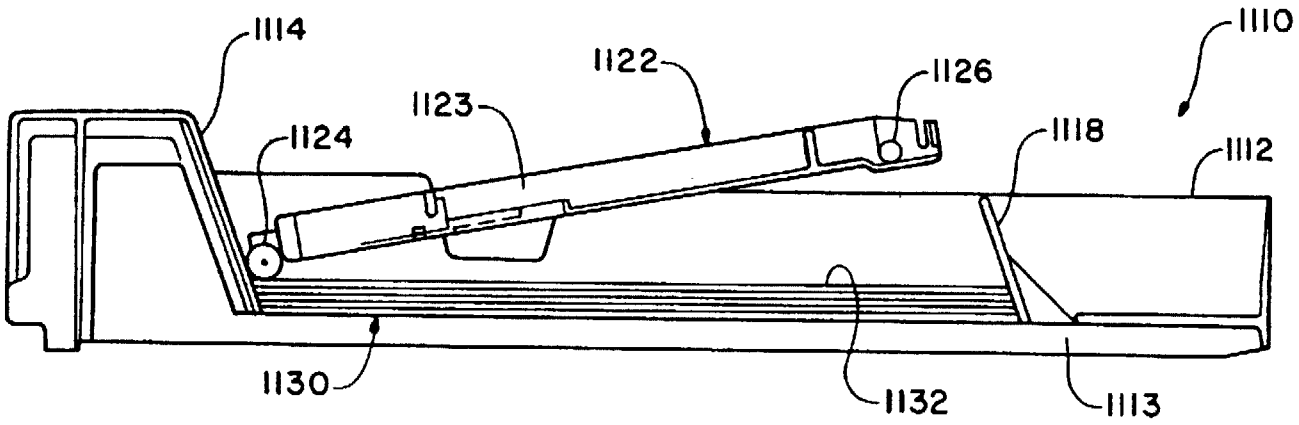
FIG. 11 is a sectional view of another sheet feeder apparatus for feeding the envelope construction of FIG. 1, and which is also constructed in accordance with the present invention.
Figure 12:
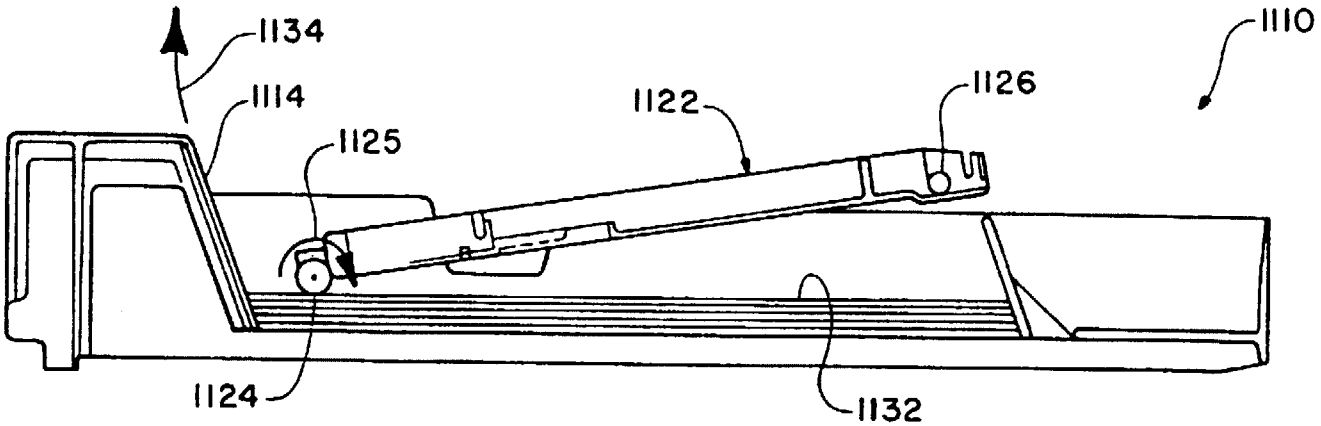
FIG. 12 is a sectional view of the sheet feeder apparatus of FIG. 11 in a rearward position.
Figure 13:
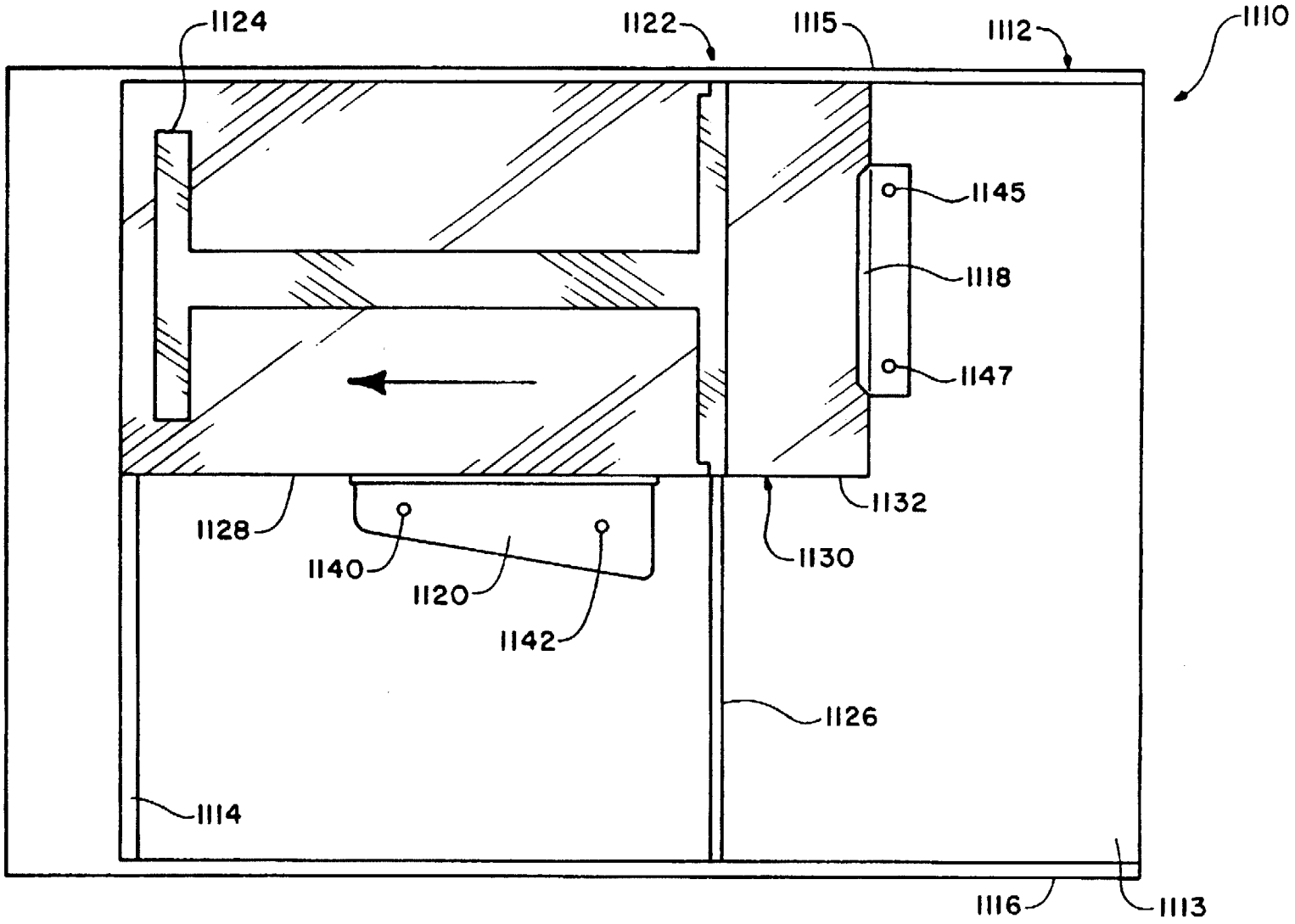
FIG. 13 is a plan view of the sheet feeder apparatus of FIG. 11 illustrating a right justified feeding position.

A center justified feeding position for the apparatus 710 is shown in FIG. 10. A pair of spaced apart guide members 1019 and 1020 are disposed between the sidewalls 715 and 716, and receive the stack 1030 therebetween. In this way, the stack 1030 is positioned within the tray 1012 between the side walls 1015 and 1016.

The sheet feeder apparatus 510 and 710 of FIGS. 5–10 are all passive retard devices, and are capable of supplying envelopes at a rate of up to about 15 epm. Higher envelope supply rates can be achieved using an articulating/singulating arm type of sheet feeder apparatus. In this regard, envelopes may be supplied at a rate between about 15 epm and about 90 epm, with a jam rate of 1 in about 10,000 or less, using an articulating arm sheet feeder apparatus.

An articulating arm sheet feeder apparatus 1110 is shown in FIGS. 11–15, and may be used to supply envelopes to a printer (not shown) at a relatively high rate of speed. The sheet feeder apparatus 1110 is described in more detail in U.S. Pat. No. 5,377,969, which description is incorporated by reference as if fully set forth herein. As described therein, the sheet feeder apparatus 1110 includes a tray 1112 having a bottom 1113 to support a stack 1130 of envelopes. The tray 1112 further includes a pair of spaced apart side walls 1115 and 1116 and an angularly inclined front wall 1114 disposed between the side walls 1115 and 1116. The front wall 1114 is inclined upwardly from the bottom 1113 by between about 21° and about 23°. An angled rear stop member 1118 is spaced apart from the front wall 1114 sufficiently to receive the stack 1130, and to prevent the stack 1130 from moving rearwardly.

A guide member 1120 (FIG. 13) is fixed relative to the bottom 1113, and spaced apart from the side wall 1115, to enclose the stack 1130 therebetween. Thus, the apparatus 1110 of FIG. 13 defines a right justified feeding position.

The guide member 1120 and the rear stop member 1118 are fixed relative to the bottom 1113 by securing devices, such as screws 1140, 1142, 1145 and 1147. It will be understood by one skilled in the art that other methods of securing the guide member 1120 and the rear stop member 1118 may also be used. For example, the guide member 1120 and the rear stop member 1118 may be slidably coupled relative to the bottom 1113 to adapt the tray 1112 to various sizes of envelopes or paper stock.

The sheet feeder apparatus 1110 further includes an articulating arm mechanism 1122 to facilitate the singulation or separation of the top envelope 1132 from the stack 1130, and to enable the top envelope 1132 to be supplied to the printer. The articulating arm mechanism 1122 includes an elongated feed arm 1123, a separation roller 1124 disposed at a forward end of the arm 1123 for engaging the top envelope 1132, and an arm shaft 1126 disposed at a rear end of the arm 1123 for moving the articulated arm mechanism 1122 forwardly and rearwardly relative to the tray 1112.

In operation, the separation roller 1124 engages the top envelope 1132 of the stack 1130, and rotates in a clockwise direction as indicated by the arrow 1125 to provide a sufficient force to overcome the sliding friction between the envelopes of the stack 1130. As a result, one or more of the upper envelopes in the stack 1130 are moved forwardly to engage the front wall 1114 which defines a feed wall or ramp.

The articulating arm 1122 (FIG. 12) is moved rearwardly relative to the front wall 1114 to move the separation roller 1124 rearwardly along the top envelope 1132. As the articulating arm 1122 moves rearwardly, the top envelope 1132 is buckled until the beam strength of the envelope 1132 is overcome.

The top envelope 1132 moves up the front wall 1114 while the next adjacent envelope in the stack 1130 is stopped by the front wall 1114. In this way, singulation and feeding of the envelopes is facilitated.

Figure 14:
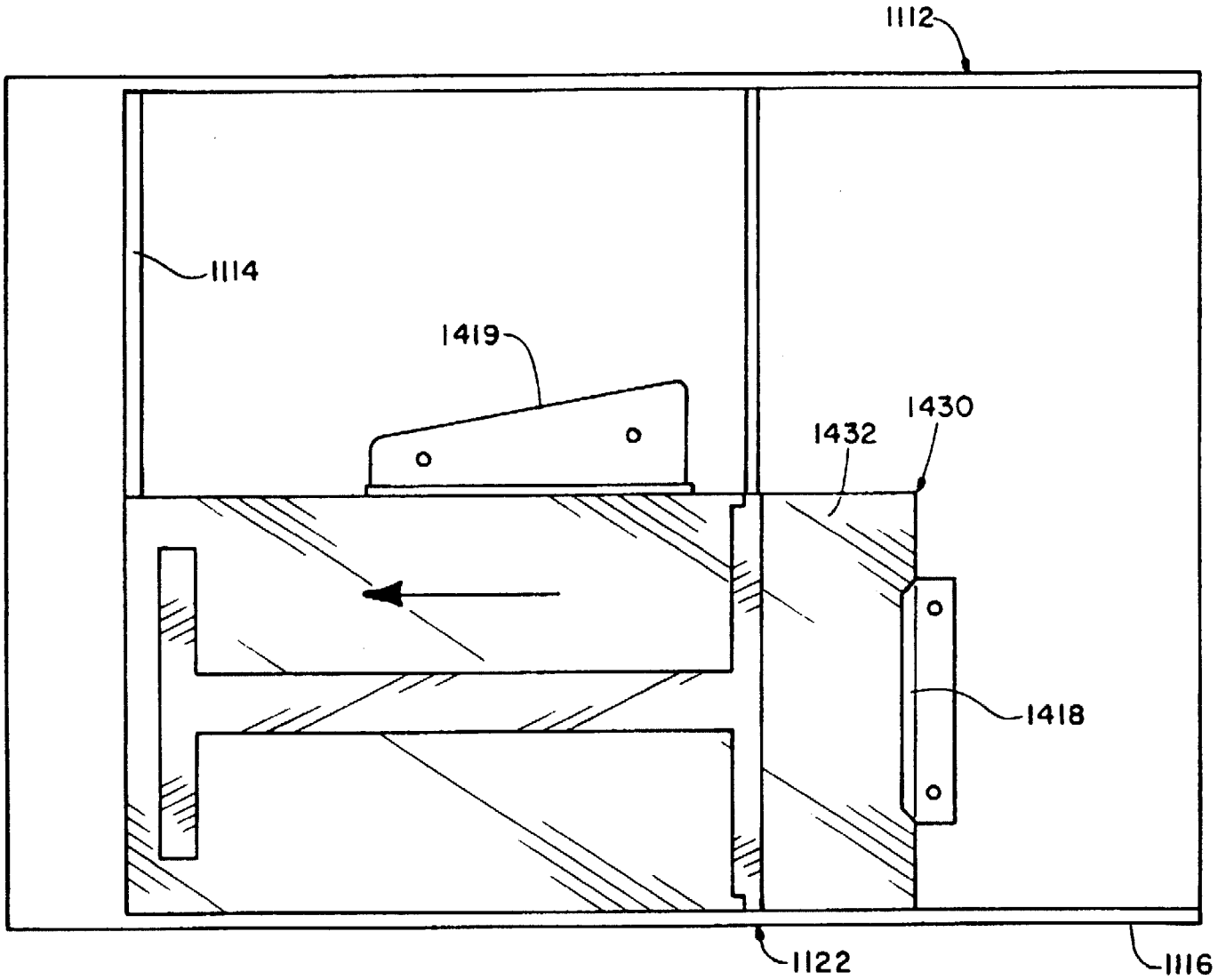
FIG. 14 is a plan view of the sheet feeder apparatus of FIG. 11 illustrating a left justified feeding position.

A left justified feeding position for the apparatus 1110 is shown in FIG. 14. In this regard, a guide member 1419 is spaced apart from the side wall 1116 to receive a stack 1430 therebetween. In addition, a rear stop member 1418 is spaced apart from the front wall 1114 to help restrain the stack 1430 therebetween.

Figure 15:
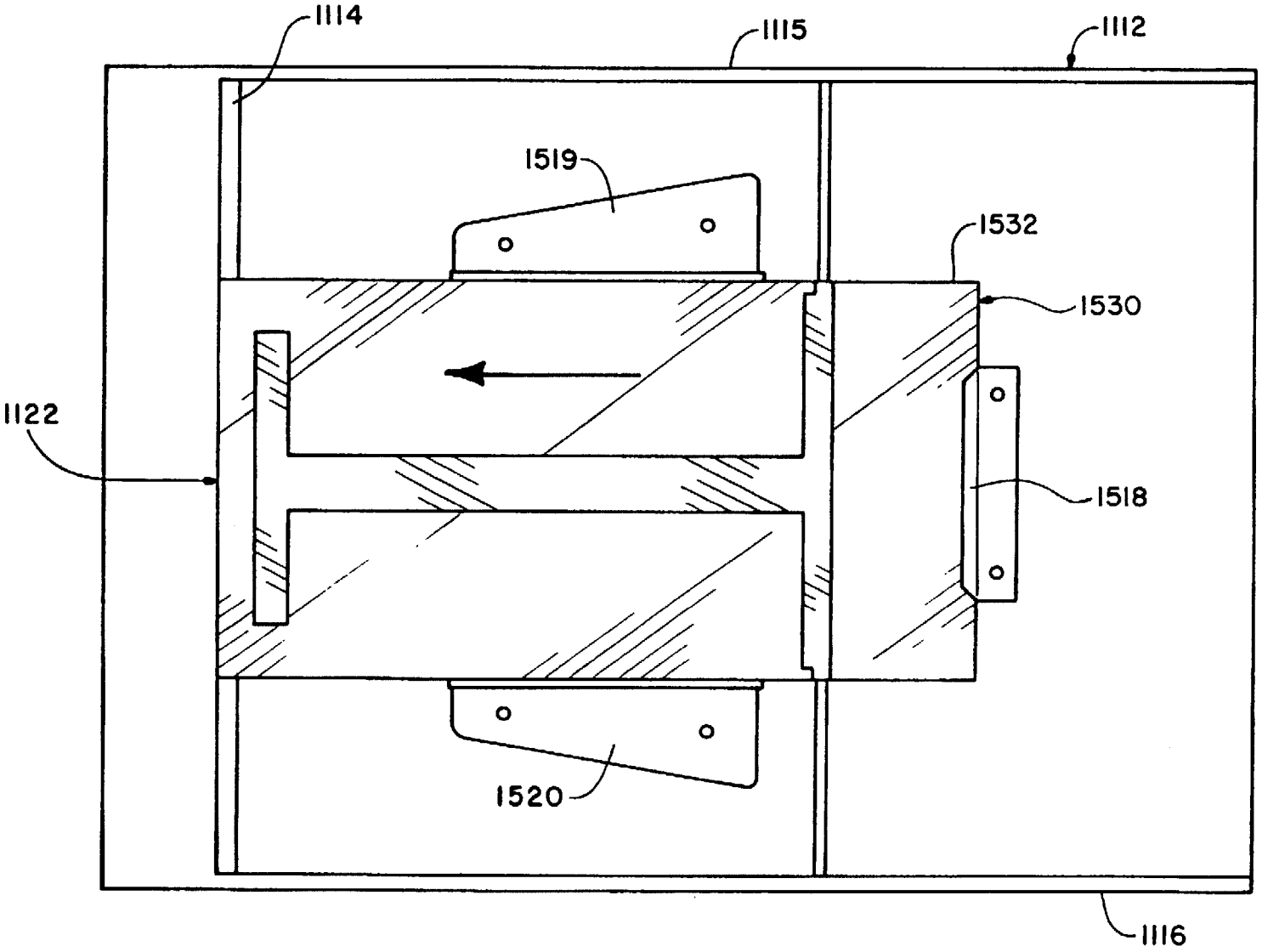
FIG. 15 is a plan view of the sheet feeder apparatus of FIG. 11 illustrating a center justified feeding position.

A center justified feeding position for the apparatus 1110 is illustrated in FIG. 15. A pair of spaced apart guide members 1519 and 1520 are disposed between the side walls 1115 and 1116 for maintaining the stack 1530 in a central portion of the tray 1512.

Thus, depending upon the printer path of a printer, the appropriate feeding justification for the sheet feeder apparatus 1110 can be selected to supply envelopes at an extremely high rate with acceptable jam rates.

Figure 16:
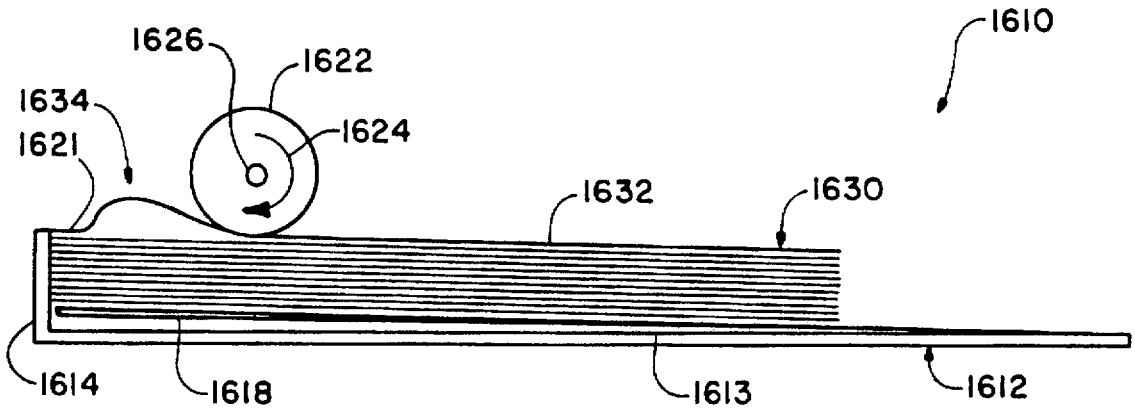
FIG. 16 is a sectional view of another sheet feeder apparatus which is constructed in accordance with the present invention.
Figure 17:
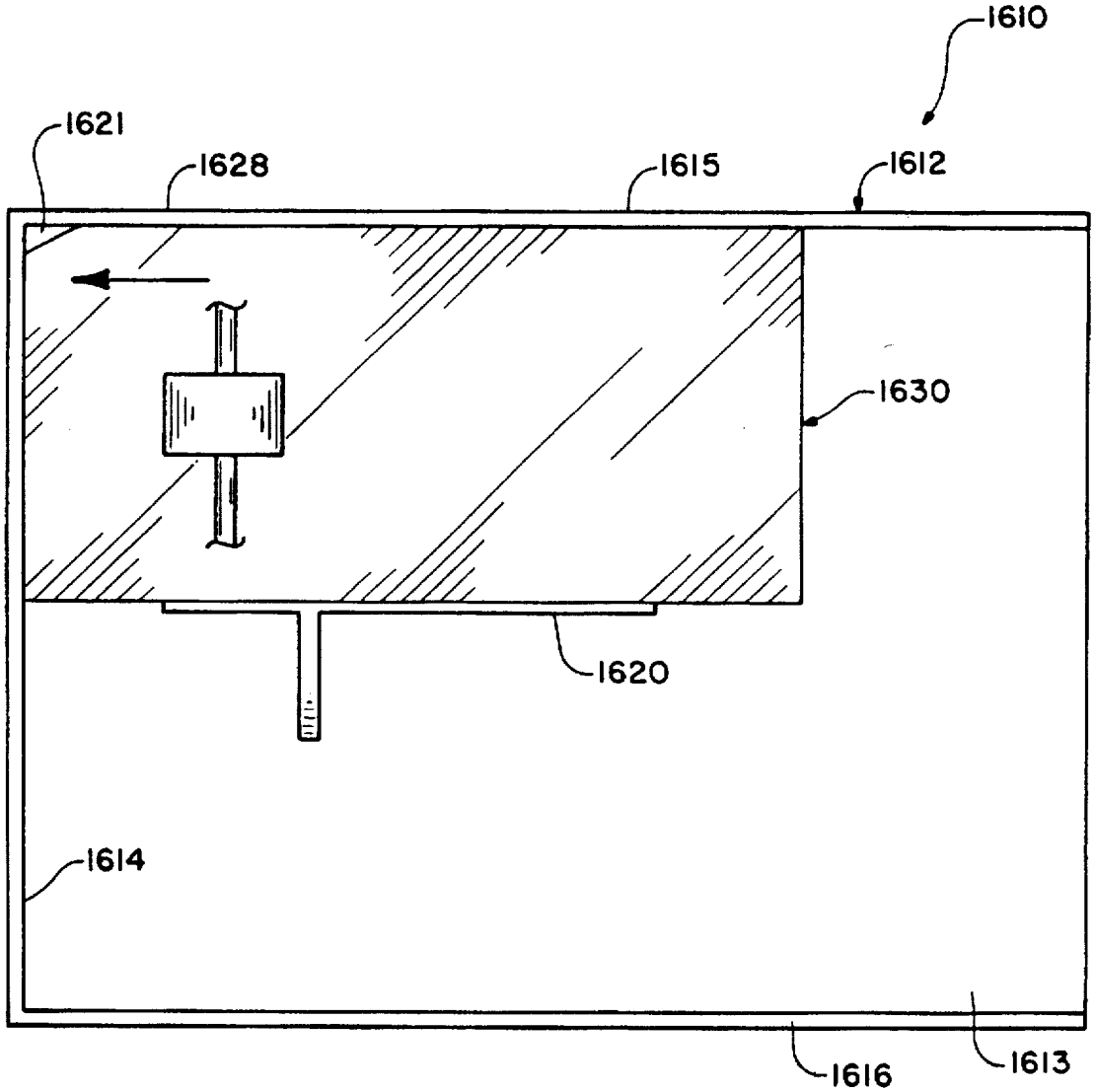
FIG. 17 is a plan view of the sheet feeder apparatus of FIG. 16 illustrating a right justified feeding position.

Another sheet feeder apparatus 1610 is illustrated in FIGS. 16 and 17, and is also constructed in accordance with the present invention. The sheet feeder apparatus 1610 is a corner buckler type of device, and is capable of supplying envelopes at the rate of up to 30 epm to an associated printer (not shown).

The sheet feeder apparatus 1610 is similar to the apparatus 510 (FIGS. 5 and 6), AND includes a tray 1612 having a bottom 1613, a pair of spaced apart side walls 1615 and 1616, and a vertical front wall 1614 disposed between the side walls 1615 and 1616.

The apparatus 1610 defines a right justified feeding position, and includes a guide member 1620 spaced apart from the side wall 1615 to receive a stack 1630 of envelopes therebetween.

A lift plate 1618 urges the stack 1630 upwardly to enable a top most envelope 1632 to engage a drive wheel 1622. The drive wheel 1622 is driven by an axle 1626 in a clockwise direction as indicated by the arrow 1624 to help singulate the top envelope 1632.

A corner member 1621 is disposed at about the junction of the front wall 1614 and the side wall 1615 for buckling the envelopes. In this regard, the corner member 1621 is fixed above the stack 1630 when the stack 1630 is received between the guide member 1620 and the sidewall 1615.

In use, the drive wheel 1622 engages the top envelope 1632 and urges it forwardly as the drive wheel 1622 rotates in the clockwise direction. The top envelope 1632 is restrained by the corner member 1621 as the envelope 1632 is urged forwardly, wherein a buckle 1634 (FIG. 16) develops in the top envelope 1632. Once buckled, the top envelope 1632 is singulated from the stack 1630 and sent over to the printer.

Figure 18:
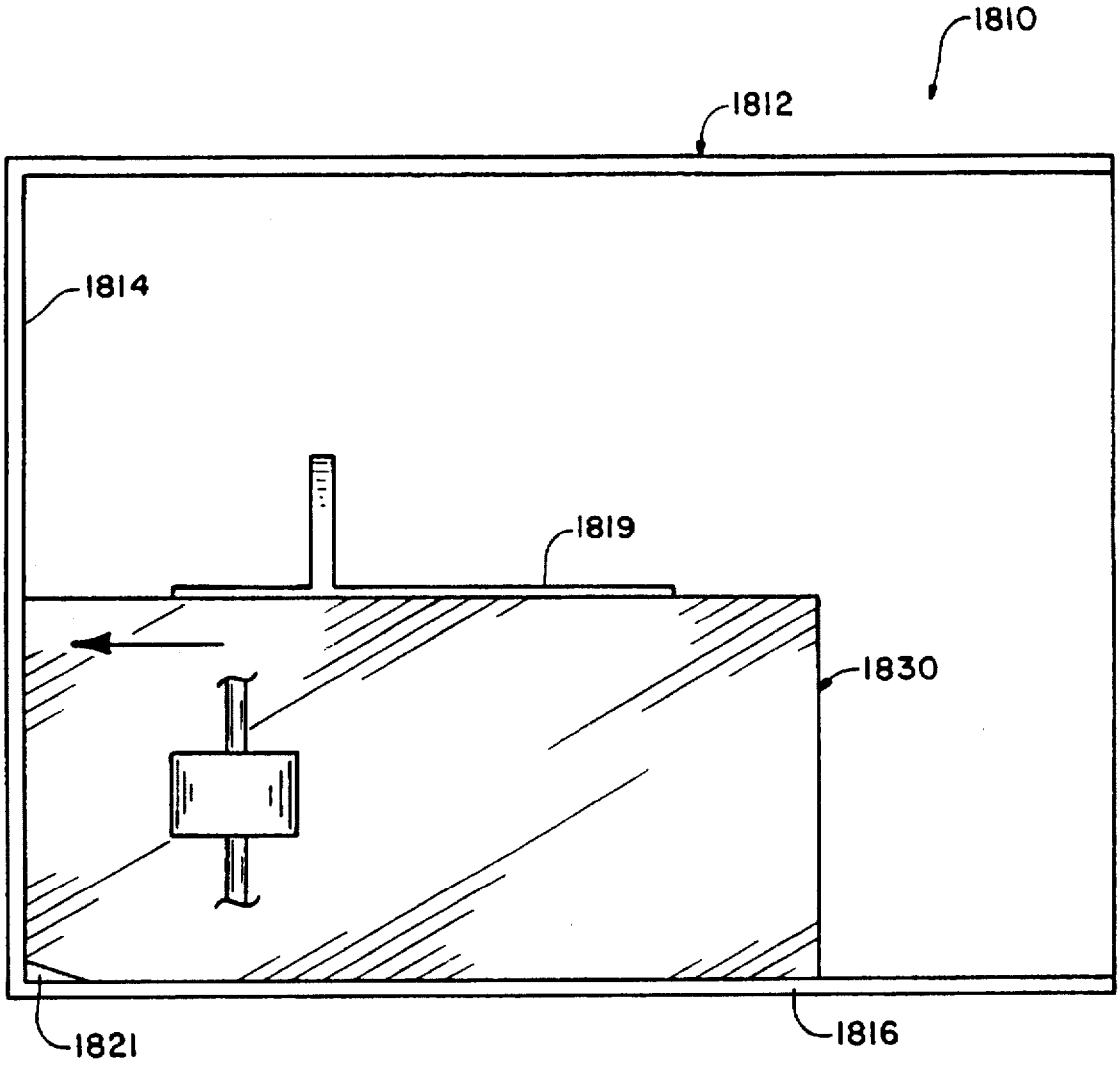
FIG. 18 is a plan view of the sheet feeder apparatus of FIG. 16 illustrating a left justified feeding position.

Another sheet feeder apparatus 1810 is shown in FIG. 18 for supplying envelopes to a printer (not shown), which is also constructed in accordance with the present invention. The apparatus 1810 is substantially similar to the apparatus 1610, except that the apparatus 1810 defines a left justified feeding position. In this regard, the apparatus 1810 includes a tray 1812 having a corner member 1821 disposed at about the junction of a side wall 1816 and a front wall 1814 for facilitating the singulation of the envelopes. A guide 1819 spaced apart from the side wall 1816 is adapted to receive a stack 1830 of envelopes therebetween.

Figure 19:
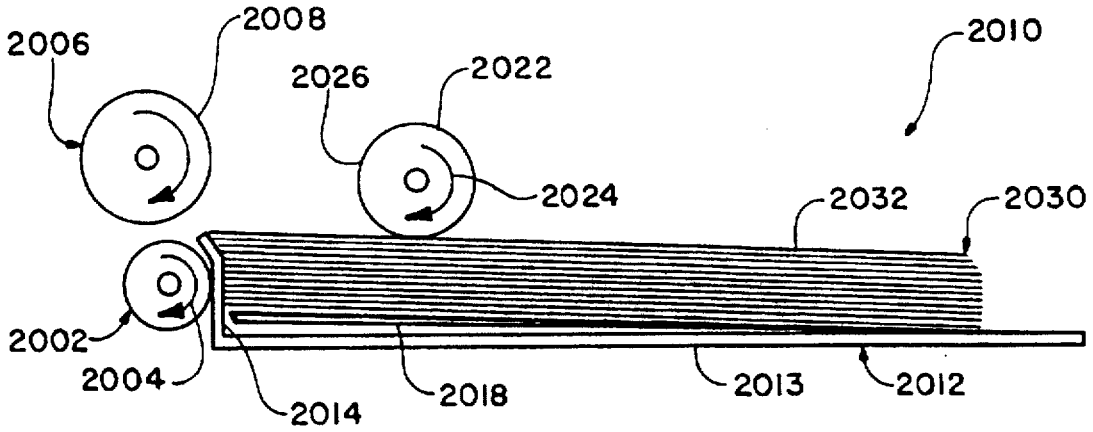
FIG. 19 is a sectional view of another sheet feeder apparatus which is also constructed in accordance with the present invention.
Figure 20:
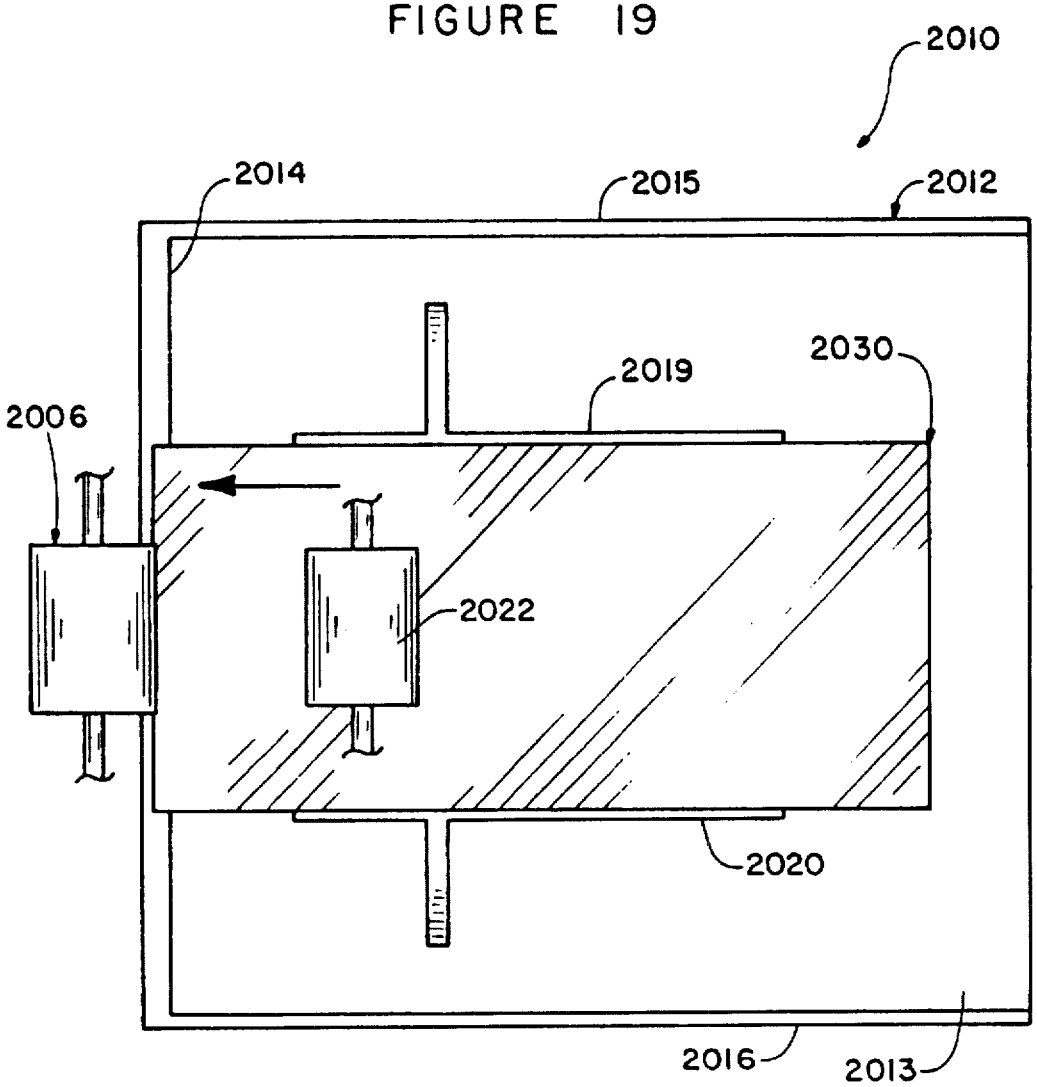
FIG. 20 is a plan view of the sheet feeder apparatus of FIG. 19 illustrating a center justified feeding position.

Referring now to FIGS. 19 and 20, there is shown another sheet feeder apparatus 2010, which is also constructed in accordance with the present invention. The sheet feeder apparatus 2010 is an active retard device and is capable of supplying envelopes at a rate of up to about 90 epm. The apparatus 2010 includes a tray 2012 which is substantially similar to the tray 712 (FIG. 7), and includes a bottom 2013, a pair of spaced apart vertical side walls 2015 and 2016, and a front wall member 2014 disposed between the side walls 2015 and 2016.

A pair of guide members 2019 and 2020 (FIG. 20) are spaced apart from one another between the side walls 2015 and 2016 to define a center justified feeding position. The spacing between the guide members can be adjusted for receiving a stack 2030 of envelopes of various sizes therebetween. A lift plate 2018 urges the stack 2030 upwardly into engagement with a drive wheel 2022 to facilitate the supply of envelopes to a printer (not shown). The drive wheel 2022 is rotated by an axle 2026 in a clockwise direction indicated by the arrow 2024 to urge the top most envelope 2032 forwardly.

When received within the printer, an active retard roller 202 is positioned at about the front wall 2014. The active retard roller 2002 rotates in a clockwise direction indicated by the arrow 2004 to engage the envelopes for preventing them from entering the printer feed path (not shown), thereby enabling the top envelope 2032 to be separated from the stack 2030. The separated envelope 2032 engages a feed roller 2006 rotating in a clockwise direction indicated by the arrow 2008 to feed the separated sheet 2032 to the printer along the feed path.

Figure 21:
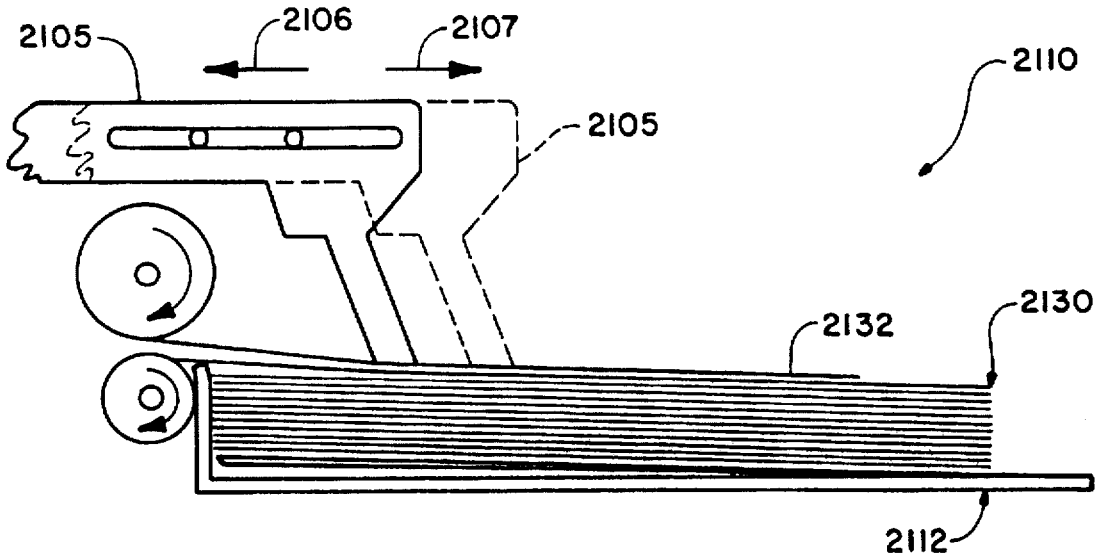
FIG. 21 is a sectional view of another sheet feeder apparatus which is also constructed in accordance with the present invention.
Figure 22:
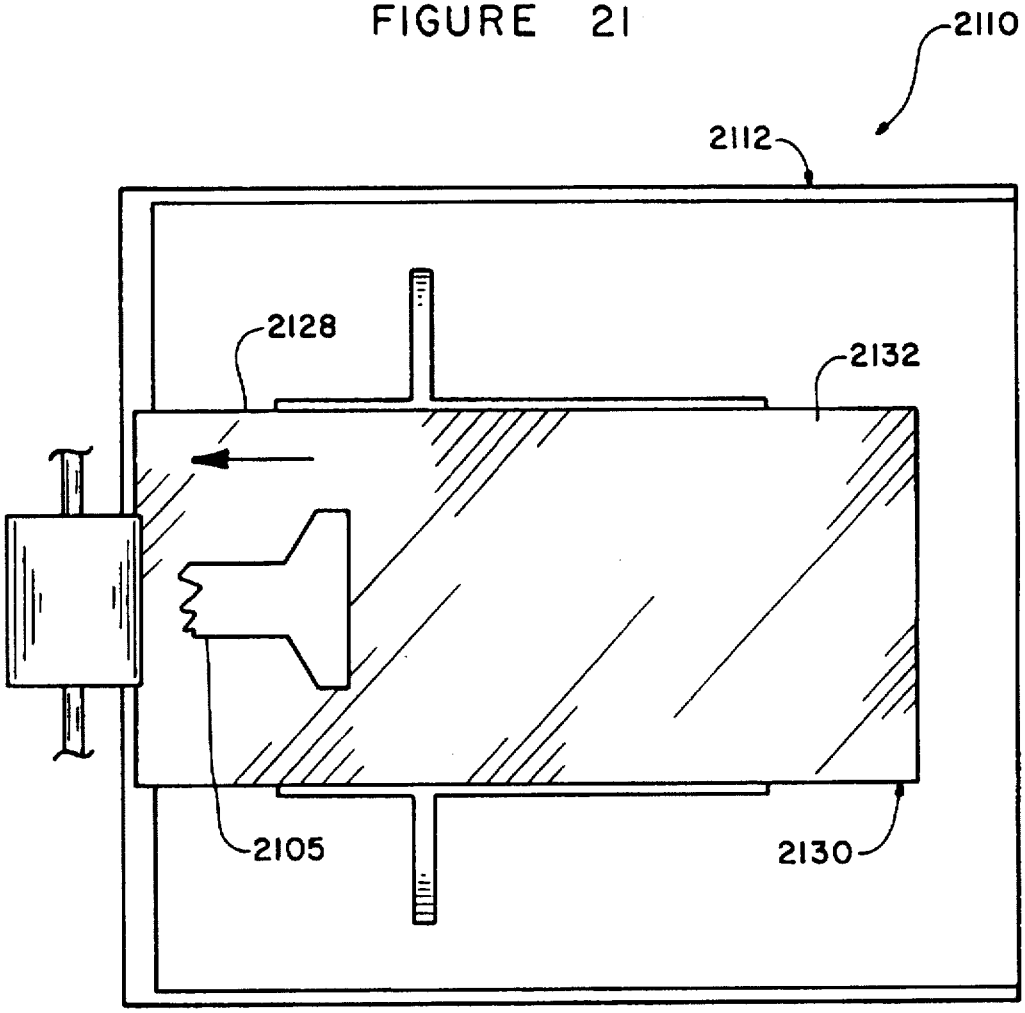
FIG. 22 is a plan view of the sheet feeder apparatus of FIG. 21 illustrating a center justified feeding position.

Another sheet feeder apparatus 2110 is shown in FIGS. 21 and 22 for supplying envelopes to a printer (not shown), and is also constructed in accordance with the present invention. The apparatus 2110 is substantially similar to the apparatus 2010 (FIGS. 19 and 20), except that the drive wheel 2022 of the apparatus 2010 has been replaced by a vacuum pick shuttle 2105 in the apparatus 2110.

The vacuum pick shuttle 2105 engages a topmost envelope 2132 from a stack 2130 of envelopes to facilitate the supply of the envelopes to the printer. The shuttle 2105 is movable forwardly and rearwardly relative to the stack 2130 to enable the top envelope 2132 to be singulated or separated from the stack 2130.

In use, the shuttle 2105 is positioned at an initial position to engage the top envelope 2132, wherein the initial position is indicated by dashed lines. The shuttle 2105 engages the top envelope 2132, and is moved forwardly as indicated by arrow 22106 to a feeding position shown in solid lines, wherein the top envelope 2132 is singulated from the stack 2130 and supplied to the printer.

The shuttle 2105 returns to the initial position, traveling rearwardly as indicated by arrow 2107, to engage the next envelope in the stack 2130. The process is repeated until a desired amount of envelopes have been supplied.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A method of envelope printing using a non-impact printer, comprising:

using a group of like single assembled envelopes, each individual envelope having a large front panel with a longitudinal length and a small single rear panel disposed in an overlying relationship on said front panel and secured to said front panel at their marginal edges to form an interior pocket, the front and rear panels having opposed natural curls to help retain a flat aspect of the envelope in high humidity environments, a flap portion of said front panel extending beyond said rear panel to form a fold over flap, an adhesive strip extending longitudinally along the back side of said flap portion for sealing the flap in a closed folded over position to said rear portion, said rear panel and said adhesive strip being generally of the same thickness to add a substantially uniformly thick layer to the back side of said front panel to provide the envelope with a generally flat aspect to enable the group of like envelopes to be stacked evenly for sheet feeding purposes;

using a paper tray;

stacking the group of like single assembled enveloped longitudinally with their flaps open within the paper tray;

retaining the generally flat aspect of the stacked envelopes having opposed curls to prevent warping or curling in high humidity;

separating the topmost one of the single assembled envelopes from the stack seriatim to feed it individually longitudinally to the printer for printing thereon; and feeding each separated single assembled envelope to the printer in a direction substantially parallel to the longitudinal length of the adhesive strip for substantially reducing jamming.

2. A method according to claim 1, wherein said separating includes using an articulating arm having a separation roller thereon, an angularly disposed paper feed ramp, arranging the stack in engagement with the ramp and moving the arm to engage the topmost one of the envelope constructions.

3. A method according to claim 1, wherein said paper feeding device and said separating include using a drive wheel for moving the topmost envelope construction, causing the topmost envelope construction to separate from the stack at high speed to be moved to the non-impact printer.

4. A method according to claim 3, further including using retard means, facilitating the separation by moving the topmost construction into engagement with said retard means.

5. A method according to claim 4, wherein said retard means including active retard roller means.

6. A method according to claim 4, wherein said retard means including corner brickler means, causing the topmost construction to engage said corner buckler means to facilitate the construction separation at high speed.

7. A method according to claim 1, wherein said paper feeding device and said separating include using vacuum pick means, and facilitating the separation of the topmost construction from the stack at high speed.

8. A method according to claim 1, further including using back stop adaptor means in the tray, and positioning the back of the stack within the tray.

9. A method according to claim 1, further including using side guide adaptor means in the tray, and positioning the side of the stack within the tray.

10. A method according to claim 1, wherein said adhesive strips includes a pressure sensitive adhesive material, and said front and rear panels each assuming its natural curl in a conforming relationship with one another to form an overall symmetrical shape to help retain the overall symmetrical shape of the construction consistent even when the panels absorb moisture to facilitate sheet feeding purposes.

11. A method according to claim 1, further including using a line of perforations extending across said flap portion between said strip and said rear panel to help retain a flat aspect to the envelope construction and to facilitate folding over said flap after printing.

12. A method according to claim 1, wherein said front and rear panels are two separate sheets.

13. A method according to claim 1, wherein said panels are each composed of paper material having a caliper of between about 3.00 mils and about 5.5 mils.

14. A method according to claim 1, wherein said panels are each composed of paper material having a surface smoothness of between about 85 Sheffield and about 150 Sheffield.

15. An envelope construction for being fed longitudinally from a stack of like envelope constructions disposed within a printer paper tray to a non-impact printer to facilitate envelope printing, comprising:

a large front paper panel having an associated natural curl and having a given thickness, said front panel having front and back sides;

a single small rear paper panel disposed in an overlying relationship on said front panel and secured to said front panel at their marginal edges to cause the panels to assume a generally unstressed flat aspect and to form an interior pocket at about one of said longitudinal edges, said rear panel having an associated natural curl and front and back sides;

said small rear panel having a thickness less than said given thickness of said front panel to reduce the overall weight of said envelope construction;

a flap portion of said front panel extending beyond said rear panel to form a fold over flap;

an adhesive strip extending across the back side of said flap portion of said front panel near one of its marginal longitudinal edges for sealing the flap in a closed folded over position to said rear portion;

means defining a line of perforations extending longitudinally spaced between said adhesive strip and said rear panel to permit the flap to be folded over thereat into a closed position;

said rear panel and said adhesive strip being generally of the same thickness to add a substantially uniformly thick layer to the back side of said front panel to provide the envelope construction with a generally flat aspect to enable a group of like envelope constructions to be stacked evenly for sheet feeding purposes; and said front and rear panels each assuming its natural curl in a confronting relationship with one another to form an overall symmetrical shape to help retain a flat aspect of the overall symmetrical shape of the construction; even when the panels absorb moisture; to facilitate stacking like constructions for sheet feeding purposes within the paper tray without substantial leaning or tilting, said panels having sufficient thickness to form its interior pocket;

wherein the envelope construction is adapted to be fed longitudinally in an assembled flap-open manner from the stack within the paper tray to the printer in the direction of the line of perforations for substantially reducing jamming.

16. An envelope construction according to claim 15, wherein said adhesive strips includes a pressure sensitive adhesive material.

17. An envelope construction according to claim 15, wherein the curl of said front panel, and the curl of said rear panel are arranged such that they are oppositely opposed concave curls.

18. An envelope construction according to claim 15, wherein said front and rear panels are fixed together along at least two marginal edges.

19. An envelope construction according to claim 18, wherein said panels are fixed together along three marginal edges.

20. An envelope construction according to claim 15, further including a line of perforations extending across said flap portion between said strip and said rear panel to help retain said flat aspect to the envelope construction and to facilitate folding over said flap.

21. An envelope construction according to claim 15, wherein said front and rear panels are two separate sheets.

22. An envelope construction according to claim 21, wherein said two separate sheets each composed of a different weight of paper material.

23. An envelope construction according to claim 15, wherein said panels are each composed of paper material having a surface smoothness of between about 85 Sheffield and about 150 Sheffield.

24. An envelope construction according to claim 23, wherein the smoothness is about 100.

25. A method of making an envelope construction for envelope printing using a non-impact printer, comprising:

using a large front panel having a longitudinal length defining a pair longitudinal edges, an associated natural curl and front and back sides;

securing an adhesive strip to the back side of the front panel along said longitudinal length at about one of said longitudinal edges;

using a single rear panel having an associated curl and front and back sides;

positioning the front and rear panels in overlying registration with one another with the curls of the panels oriented in an opposing concave manner to cause the panels to assume a generally flat aspect of the overall symmetrical shape of the construction to permit like constructions to be stacked and fed from a non-impact printer paper tray effectively, where said rear panel is disposed in a spaced apart relationship from the strip, said panels having sufficient thickness to enable the resulting construction to have sufficient rigidity to serve as an envelope;

securing said rear panel to the back side of said front panel to form an envelope pocket at about another one of said longitudinal edges, perforating said front panel transversely between said adhesive strip and said rear sheet to permit it to be folder over.

26. The method of making an envelope construction, according to claim 25, wherein the step of securing said rear panel to said front panel includes securing said panels with an adhesive.

27. The method of claim 25, further including perforating the front panel along a line extending between the strip and the rear panel.

28. An apparatus for dispensing envelopes at high speeds, comprising:

a housing;

a supply of envelopes, each individual envelope having a large front panel with a longitudinal length defining a pair of longitudinal edges and an associated curl, and a small single rear panel disposed in an overlying relationship on said front panel and secured to said front panel at their marginal edges to form an interior pocket at about one of said longitudinal edges, said rear panel having an associated curl, a flap portion of said front panel extending beyond said rear panel to form a fold over flap, an adhesive strip extending longitudinally across the back side of said flap portion of said front panel near another one said longitudinal edges for sealing the flap in a closed folded over position to said rear portion, said rear panel and said adhesive strip being generally of the same thickness to add a substantially uniformly thick layer to the back side of said front panel to provide the envelope construction with a generally flat aspect to enable the group of like envelope constructions to be stacked evenly for sheet feeding purposes, said front and rear panel curls being arranged in a confronting relationship with one another to form an overall symmetrical shape to help retain the overall symmetrical shape of each envelope even when the panels absorb moisture to facilitate envelope feeding purposes;

a payment receiving mechanism located within said housing to accept payment for envelopes from a customer;

a sheet feeder within said housing for delivering individual ones of said envelopes seriatim in response to said payment mechanism receiving payment;

a bin for storing said supply of envelopes in a to facilitate supplying said envelopes longitudinally to said sheet feeder.

29. A method for dispensing envelopes from a kiosk, comprising:

using a supply of envelopes, each individual envelope having a large front panel with a longitudinal length defining a pair of longitudinal edges and a small single rear panel disposed in an overlying relationship on said front panel and secured to said front panel at their marginal edges to form an interior pocket at about one of said longitudinal edges, a flap portion of said front panel extending beyond said rear panel to form a fold over flap, an adhesive strip extending longitudinally across the back side of said flap portion of said front panel near another one said longitudinal edges for sealing the flap in a closed folded over position to said rear portion, said rear panel and said adhesive strip being generally of the same thickness to add a substantially uniformly thick layer to the back side of said front panel to provide the envelope construction with a generally flat aspect to enable the group of like envelope constructions to be stacked evenly for sheet feeding purposes;

storing said envelopes in a stack;

accepting payment for said envelopes to be dispensed;

activating a sheet feeder upon payment;

aligning said stack of envelopes longitudinally relative to said sheet feeder in a bin within said kiosk;

delivering said envelopes from said bin to said sheet feeder in a direction substantially parallel to said longitudinal length;

moving said envelopes from said sheet feeder for delivery to a customer, wherein said envelopes are each constructed by using a large front panel having a longitudinal length defining a pair longitudinal edges, an associated natural curl and front and back sides;

securing an adhesive strip to the back side of the front panel along said longitudinal length at about one of said longitudinal edges;

using a single rear panel having an associated curl and front and back sides;

positioning the front and rear panels in overly registration with one another with the curls of the panels oriented in an opposing manner, where said rear panel is disposed in a spaced apart relationship from the strip; and securing said rear panel to the back side of said front panel to form an envelope pocket at about another one of said longitudinal edges.

* * * * *